US006100647A

United States Patent [19]

Giannopoulos et al.

[11] Patent Number: 6,100,647

[45] Date of Patent: Aug. 8, 2000

[54] LAMP BALLAST FOR ACCURATE CONTROL OF LAMP INTENSITY

[75] Inventors: Demetri J. Giannopoulos, Norwalk, Conn.; Ihor T. Wacyk, Briarcliff Manor, N.Y.; Sreeraman Venkitasubrahmanian, Naperville, Ill.

[73] Assignee: Philips Electronics North America Corp., New York, N.Y.

[21] Appl. No.: 09/221,957

[22] Filed: Dec. 28, 1998

[51] Int. Cl.[7] ..... H05B 37/02

[52] U.S. Cl. ..... 315/224; 315/194; 315/307; 315/209 R; 315/DIG. 4; 315/DIG. 7

[58] Field of Search ..... 315/307, 224, 315/219, 209 R, 244, 247, 194, DIG. 4, DIG. 7, 291

[56] References Cited

U.S. PATENT DOCUMENTS 4,952,849 8/1990 Fellows et al. ..... 315/307
5,559,395 9/1996 Vekitasubrahmanian et al. ..... 315/247
5,742,134 4/1998 Wacyk et al. ..... 315/307

FOREIGN PATENT DOCUMENTS 1961325 7/1997 Germany .

*Primary Examiner*—Haissa Philogene
*Attorney, Agent, or Firm*—Leroy Eason

[57] ABSTRACT

An electronic ballast for an electron discharge lamp includes a resonant inverter driven by a high frequency switching signal supplied by a drive circuit which is substantially comprised in an integrated circuit, the lamp being connected in an output circuit of the inverter and powered thereby. The lamp intensity is controlled by changing the switching signal frequency, thereby changing the power supplied to the lamp. In order to prevent parasitic capacitance of remote wiring between the ballast and the lamp from causing inaccuracies in determination of the power being supplied to the lamp, the ballast takes into account the phase difference between lamp current and voltage in making such determination. For example, by deriving the product of rectified lamp voltage and rectified lamp current, and using the arithmetic summation of such products during each operating cycle as a measure of lamp power.

5 Claims, 4 Drawing Sheets

LAMP BALLAST FOR ACCURATE CONTROL OF LAMP INTENSITY

BACKGROUND OF THE INVENTION

1. Field of the Invention

The invention relates to an electronic ballast for a gas discharge lamp, and more particularly to such a ballast which enables accurate control of the lamp intensity by an externally supplied dimming signal for adjusting the power supplied to the lamp even at very low illumination levels (e.g. 1 or 2% of maximum intensity) and even when the ballast is coupled to the lamp by remote wiring having significant stray capacitance.

2. Description of the Related Art

U.S. Pat. No. 5,742,134, issued Apr. 21, 1998 to the present Applicants and assigned to the present Assignee, Philips Electronics N.A., discloses an electronic ballast comprising a half-bridge inverter which includes a pair of serially connected MOSFET switches for generating a high frequency square wave in a resonant output circuit in which the lamp is connected. The inverter is driven by a drive control circuit principally consisting of an integrated circuit (IC) having pins corresponding to various operating parameters of the ballast, such as lamp current, voltage and power, as well as a pin for receiving an external dimming control signal. A feedback loop in the IC controls the lamp intensity by varying the switching frequency of the inverter, a change in frequency in the vicinity of resonance of the inverter output circuit causing a substantial change in lamp current and voltage and consequently in the power supplied to the lamp. A signal which is used as a measure of lamp power is obtained as the product of measured average lamp current and measured average lamp voltage, which power signal is used to derive an error signal for adjusting the lamp intensity to a level signified by an externally supplied dimming signal. Linear control of lamp intensity is thereby provided over a range down to as low as 1 or 2% of full intensity. Such patent is incorporated herein by reference, and constitutes a part hereof as fully as if set forth herein.

A problem is encountered with such a ballast when it must be located at some distance from the lamp, so that remote wiring is necessary which introduces significant parasitic capacitance there-between. As a result of such capacitance the lamp current and voltage as detected at the ballast can have a significant phase difference. Consequently, the actual lamp power is no longer simply the product of average (i.e., DC) lamp current and voltage but rather is given by an integration of the product of actual lamp voltage and current over each periodic cycle thereof. At low intensity levels the lamp current may be of the same order of magnitude as the parasitic capacitive current, and so the current and power as measured at the ballast can become altogether erroneous as a measure of actual lamp current and power. That will result in erroneous control of lamp intensity, and can also cause difficulty in lamp start-up because the parasitic current will be interpreted by the ballast as lamp current and consequently as an indication that ignition has occurred and therefore that the lamp voltage can be reduced from the required start-up level.

SUMMARY OF THE INVENTION

An object of the present invention is to provide a modification of the known ballast whereby instead of measuring lamp power as a product of average lamp current and lamp voltage it is measured as a product of actual lamp current and voltage, taking into account the phase relationship there-between. More particularly, the invention provides an auxiliary IC for use with the basic IC (known as the "α" IC) of the known ballast, the auxiliary IC therefore being referred to as an "α2" IC. It includes a first rectifier for rectifying a differential voltage representative of lamp current and producing a rectified ac current corresponding to said rectified voltage, a second rectifier for rectifying a current representative of the lamp voltage, and a current-mode single quadrant multiplier for multiplying the two rectified currents. The output current of the multiplier is averaged to derive a dc voltage proportional to the actual power being supplied to the lamp. Such multiplication takes into account whether the lamp voltage and current are of the same or different signs during each power cycle, the then existing dc voltage representative of lamp power being increased when the lamp voltage and current are of the same sign and being decreased when they are of opposite sign. Thus, the phase relationship there-between during each quadrant of each cycle is taken into account in deriving the value of the dc voltage representative of lamp power. Since the parasitic capacitive current is 90° out of phase with the lamp voltage, the average value of the product of that current and lamp voltage is zero and so it does not affect the accuracy of the power signal derived as described.

BRIEF DESCRIPTION OF THE DRAWINGS

The invention will now be described in more detail with reference to the accompanying drawings, wherein.

BASIC FEATURES OF THE PRIOR ART BALLAST

Figure 1:
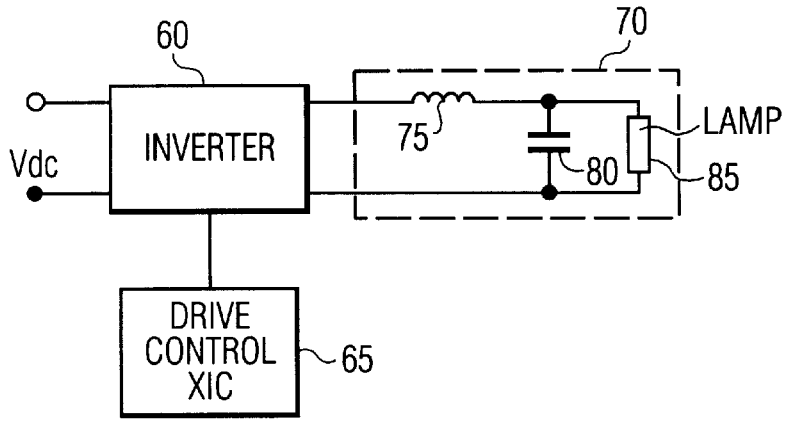
FIG. 1 is a block diagram of the basic structure of a lamp ballast as in the above-identified patent as well as of the lamp ballast of the present invention.

In order to describe how the present invention improves upon the prior art ballast of the above-identified patent, a description will first be given of the basic features of such ballast which are also applicable to the ballast of the present invention. Referring to FIG. 1, it shows a simplified block diagram of a ballast as in the aforesaid patent. A substantially constant dc voltage which is selectable over a range of 240 to 500 volts is supplied to an inverter 60 which comprises a switch mode power supply driven by a high frequency switching signal produced by a drive control circuit 65 which includes the αIC. The switching frequency may be about 45 kHz, and results in a square wave of that frequency at the output of inverter 60. Such output is applied to a load 70 which includes a series resonant inductor 75 and capacitor 80. The resonant frequency is somewhat below the switching signal frequency, whereby the lamp intensity can be increased or decreased by lowering or raising the switching signal frequency.

Figure 2:
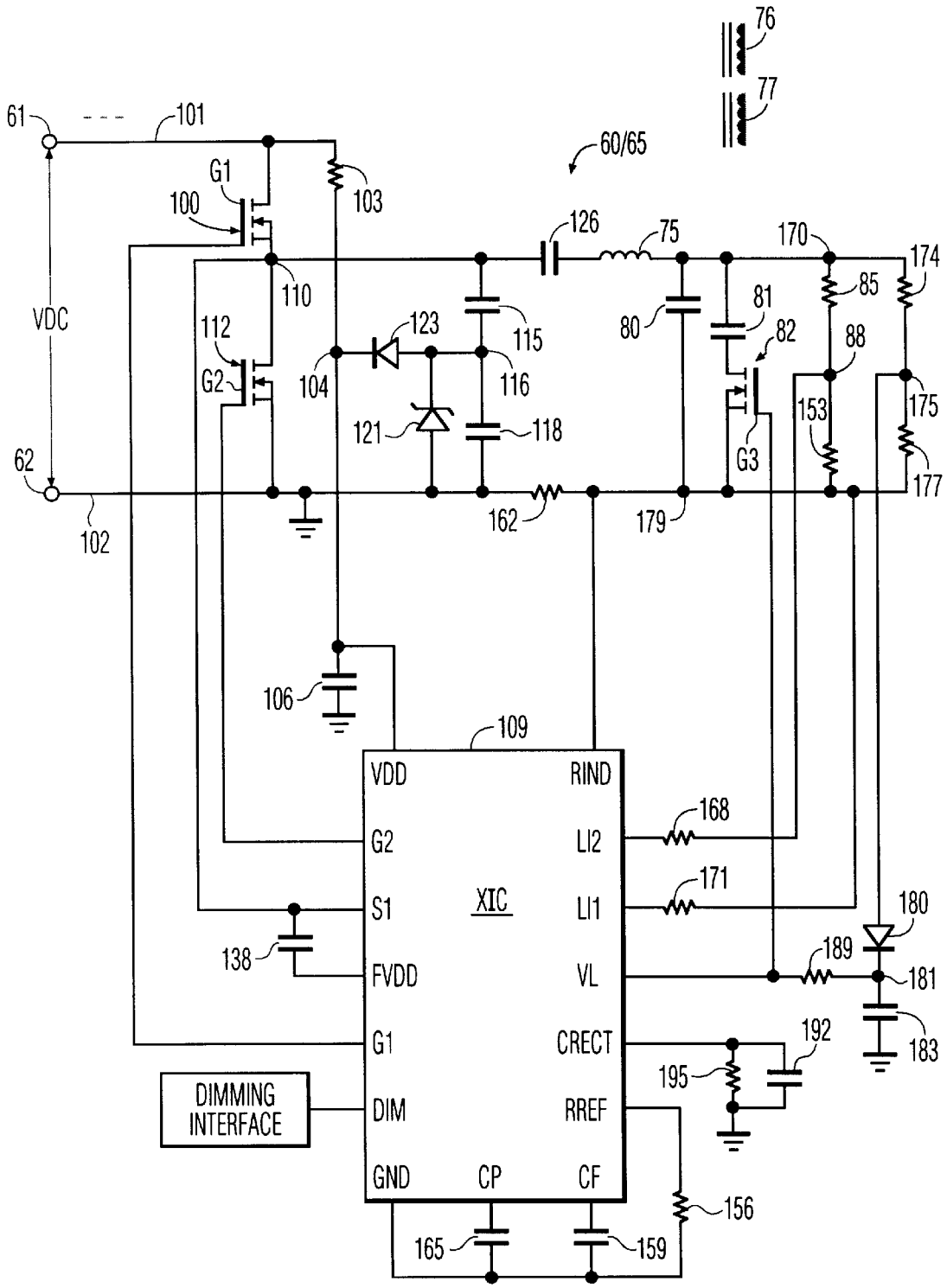
FIG. 2 PRIOR ART
FIG. 2 is a more detailed drawing of the structure of the ti lamp ballast in FIG. 1, and is the same as FIG. 2 of said patent except for omission of the interface circuit for supplying an external dimming control signal to the DIM pin of the αIC 109, and omission of the optional deep dimming external offset shown in the dotted block 198 in FIG. 2 of said patent. The identifying numerals used in FIG. 2 herein are the same as in FIG. 2 of said patent.

The ballast circuit arrangement in FIG. 1 is shown in more detail in FIG. 2, which is identical to FIG. 2 of the above-identified patent except for omission of the dimming interface circuitry connected to the DIM pin of αIC 109 since such interface is only one of many possible interfaces for supplying a dim control signal to the DIM pin. The dimming signal interface circuit 110 is therefore only shown in block form. Also omitted is the optional external offset circuit shown in dotted block 198 of FIG. 2 of said patent for use at deep dimming levels down to 1% of full light intensity. It could, however, optionally be included.

Since the ballast in FIG. 2 of said patent is described in detail therein further detailed description of the structure thereof is unnecessary. However, in order to fully explain the improvement achieved by the present invention, a description of certain of the operational characteristics of the ballast in FIG. 2 will now be given.

The difference between the current sensed at pins LI1 and LI2 of the αIC 106 is representative of the current flowing through lamp 85. The voltage across the lamp, scaled by the voltage divider formed by resistors 174 and 177, is detected by diode 180 and capacitor 183, resulting in a dc voltage at junction 181 which is proportional to the peak lamp voltage. That voltage is converted into a current into pin VL of the αIC by resistor 189. Within the αIC 109, the current at pin VL (representative of peak lamp voltage) and the difference of the currents at pins LI1 and LI2 (representative of average lamp current) are multiplied together to obtain a rectified ac current which is fed out of pin CRECT into the parallel combination of capacitor 192 and resistor 195. Such rectified ac current is thereby converted into a dc voltage which is proportional to the average power of lamp 85. A feedback circuit contained in the αIC operates to change the switching frequency of inverter 60 until the voltage produced by the current at the CRECT pin becomes equal to the voltage supplied to the DIM pin from an external dimming interface. To be noted is that the current produced at the CRECT pin, flowing to ground through the parallel combination of resistor 195 and capacitor 192, is indicative of the average power of lamp 85 (the product of average lamp current and voltage).

A resistor 156 connected between pin RREF and ground serves to set a reference current within the αIC, and a capacitor 159 connected between pin CF and ground sets the frequency of a current controlled oscillator (CCO) comprised in the αIC for generating the switching signals for gates G1 and G2 of switches 100 and 112 of inverter 60. A capacitor 165 connected between pin CP and ground is used for timing of a preheat cycle and also the timing of a nonoscillatory/standby mode. A pin FVDD connected to junction 110 by a capacitor 138 represents a floating supply voltage for the αIC.

During an initial startup period capacitor 106 is charged in accordance with the RC constant of capacitor 106 and resistor 103. During that period switch 100 is nonconducting and switch 112 is in the conducting state, the input current into pin VDD of the αIC being maintained at a low level (less than 500 microamp). Capacitor 138, between pin FVDD and junction 110, charges to a relatively constant voltage of approximately VDD which serves as the supply voltage for the drive circuit of switch 100. When the voltage across capacitor 106 reaches a threshold turnon value (e.g. 12 volts), the αIC enters its operating state (oscillatory/switching) with switches 100 and 112 switching back and forth between the conducting and the nonconducting states at a frequency which is well above the resonant frequency set by inductor 75 and capacitor 80.

The αIC initially enters a preheat cycle when the inverter begins oscillating. During that cycle the lamp 85 is not yet in the ignited state. The initial operating frequency of the αIC, which is about 100 kHz, is set by resistor 156 connected to pin RREF and capacitor 159 connected to pin CF, and the reverse diode conducting times of switches 100 and 112. That frequency is then reduced by the αIC at a rate determined thereby and the frequency is reduction continues until the peak voltage across resistor 162 as sensed at the RIND pin reaches a predetermined negative peak value such as −0.4 volts. The switching frequency of switches 100 and 112 is regulated by the αIC so as to maintain the sensed voltage at the RIND pin equal to −0.4 volts, which results in a substantially constant frequency of about 80–85 kHz at junction 110. A relatively constant rms current flows through inductor 75, which may be coupled to filaments 76 and 77 of lamp 75 to precondition them for subsequent lamp ignition. The duration of the preheat cycle is set by capacitor 165. If that capacitor is omitted, there will be no preheating and that will result in instant start operation.

At the end of the preheat cycle, as determined by capacitor 165, the αIC starts sweeping the switching frequency down toward an unloaded resonant frequency (i.e. of inductor 75 and capacitor 80 before ignition of lamp 85, e.g. 60 kHz). As the switching frequency approaches such resonant frequency the voltage across the lamp rises rapidly (e.g. 600–800 volts peak) and is generally sufficient to ignite the lamp. Once that occurs, the lamp current rises from a few milliamps to several hundred milliamps. The current through resistor 153, which is equal to the lamp current, is sensed at pins LI1 and LI2 of the αIC based on the difference between the currents thereat as proportioned by resistors 168 and 171 respectively. The voltage of lamp 85, which is scaled by the voltage divider formed by resistors 174 and 177, is detected by diode 180 and capacitor 183 resulting in a dc voltage proportional to the peak lamp voltage, at junction 181. The voltage at junction 181 is converted into a current by resistor 189 flowing into pin VL.

The current flowing into pin VL is multiplied within the αIC 109 by a current corresponding to the differential current between pins LI1 and LI2, resulting in a rectified ac current fed out of pin CRECT into the parallel combination of capacitor 192 and resistor 195. That combination converts the ac rectified current into a dc voltage which is proportional to the average power of lamp 85. The voltage at the CRECT pin is forced equal to the voltage at the DIM pin by a feedback loop contained within the αIC 109. Thus, regulation of the power consumed by lamp 85 is obtained.

The desired illumination intensity level of lamp 85 is set by the voltage applied to the DIM pin of the αIC 109. For that purpose, the αIC comprises the aforesaid feedback loop including a lamp voltage sensing circuit and a lamp current sensing circuit. The switching frequency of the inverter is adjusted by such feedback loop so that the CRECT pin voltage is made equal to the voltage applied to the DIM pin. The DIM voltage varies between 0.3 and 3.0 volts, which is a 1:10 ratio. When it rises above or falls below that range it is clamped internally by the αIC to 3.0 or 0.3 volts, respectively.

The voltage at the CRECT pin is zero when lamp 85 ignites. As the lamp current increases the current at the CRECT pin, which is proportional to the product of average lamp voltage and current, charges capacitor 192 to a voltage proportional to said product. The switching frequency of the inverter circuit decreases or increases until the voltage at the CRECT pin becomes equal to the voltage at the DIM pin. When the dimming level is set to full (100%) light output, capacitor 192 is permitted to charge to 3.0 volts, and therefore the CRECT pin voltage rises to 3.0 volts based on the feedback loop. During such rise in voltage the feedback loop remains open. Once the CRECT pin voltage reaches about 3.0 volts, the feedback loop closes. Similarly, when the dim level is set to minimum light output, capacitor 192 is permitted to charge to 0.3 volts and therefore the CRECT pin voltage rises to 0.3 volts based on the feedback loop. Generally, 0.3 volts at the DIM pin corresponds to 10% of full light output. When the dim level is set to minimum light output, the CRECT capacitor 192 charges to 0.3 volts before the feedback closes.

MODIFIED BALLAST IN ACCORDANCE WITH THE INVENTION

Figure 3:
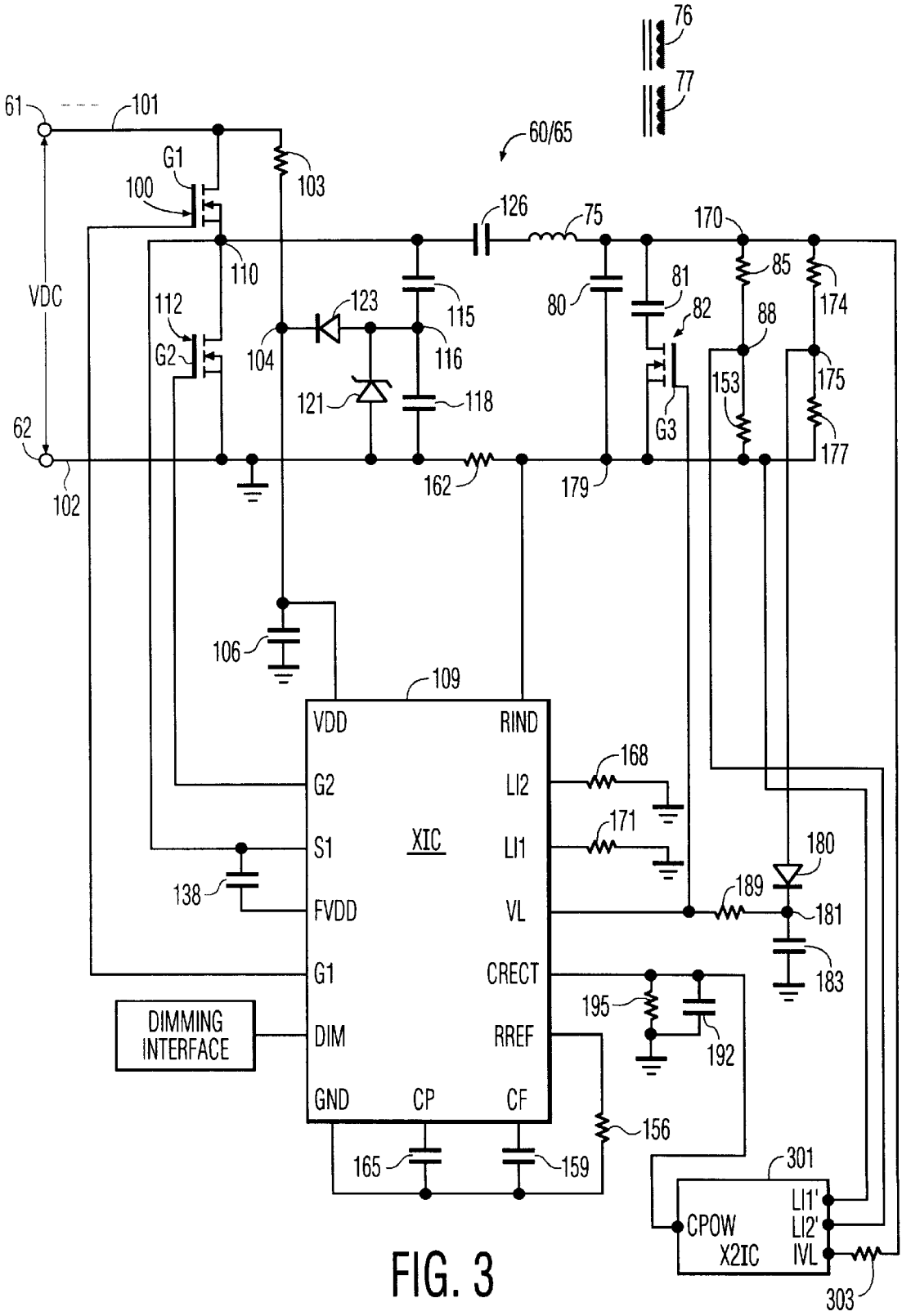
FIG. 3 is a drawing of the ballast as in FIG. 2 modified in accordance with the present invention to include an α2 IC as stated above.
Figure 5:
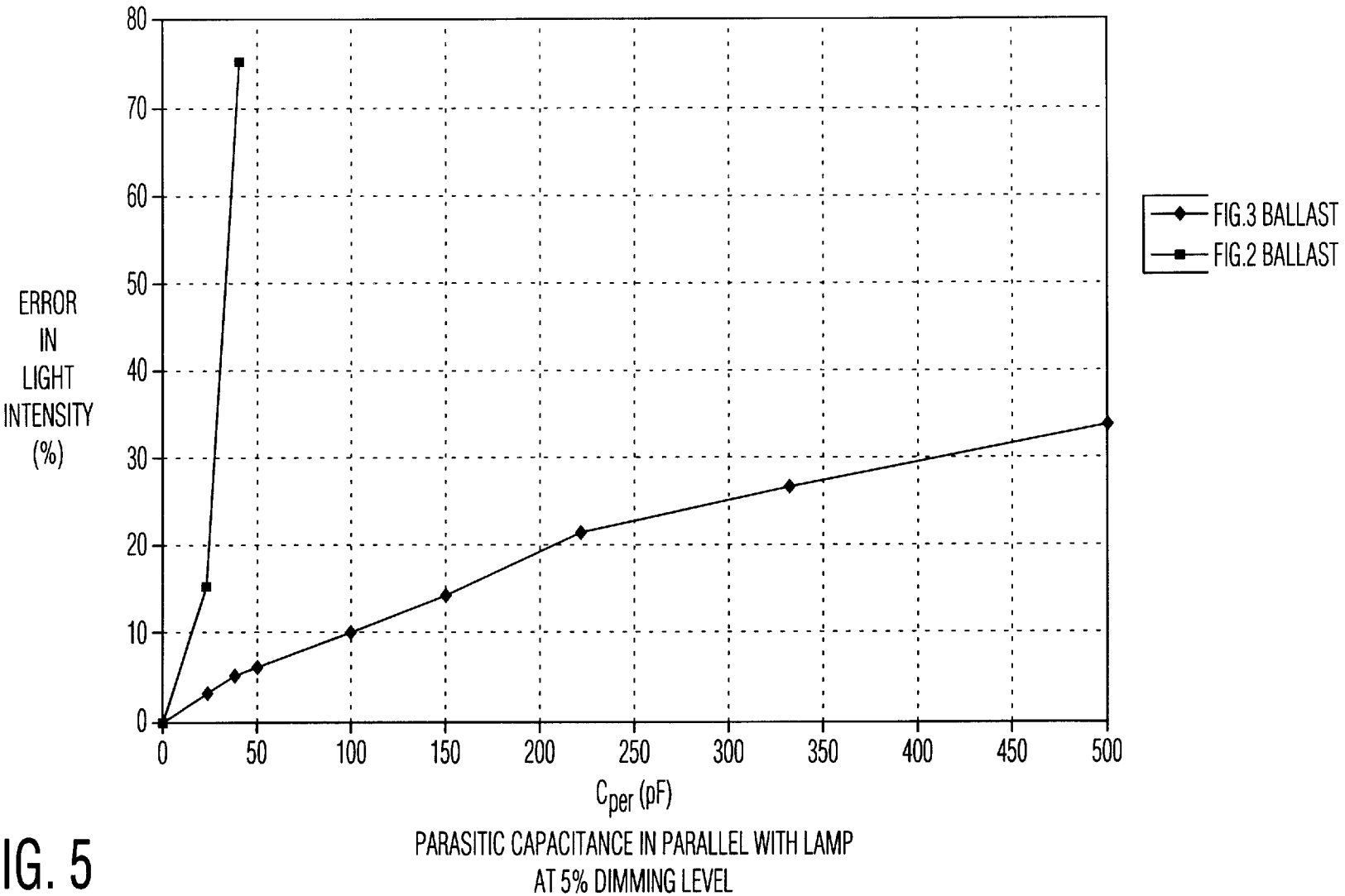
FIG. 5 is a graph showing the improvement in accuracy of measured lamp intensity at different values of parasitic capacitance of the remote wiring between the lamp and a ballast in accordance with the invention, as contrasted with the ballast of said prior art patent.

A modified ballast in accordance with the invention is as shown in FIG. 3, and is basically the same as the FIG. 2 ballast except for the addition of an auxiliary IC, denoted the α2 IC, which functions as a co-processor with the original αIC 109. In FIG. 3 the resistors 168 and 171 which are connected to pins LI1 and LI2 of the αIC 109 are both connected to ground, thereby setting the differential input current at those terminals to zero. Consequently, the measured current and the voltage corresponding thereto at the CRECT pin will be zero. Instead, the CRECT voltage formerly used in the feedback loop of the αIC is now generated by the CPOW pin current of the α2 IC 301, which current is proportional to the instantaneous product of lamp current and voltage and consequently to the actual lamp power. The lamp current is now differentially sensed at the LI1' and LI2' pins of the α2 IC 301, which pins are connected across the resistor 153 between lamp 85 and ground. The lamp voltage is sensed at the IVL pin of the α2 IC 301, which pin is connected by a resistor 303 to the lamp terminal 170 corrected to the junction between inductor 75 and capacitor 80. The CPOW pin of the α2 IC is connected to the CRECT pin of the αIC, and the ac current generated at the CPOW pin is converted by the parallel combination of capacitor 192 and resistor 195 into a dc voltage which is proportional to the actual lamp power. That sensed voltage is supplied as the CRECT voltage of the αIC, and so serves as the feedback voltage of the error amplifier in the αIC as described in said patent. The reference voltage of the feedback loop therein is controlled by the voltage supplied to the DIM pin, and so the supplied dimming voltage controls the actual lamp power level. As in the case of the original ballast, the differential lamp current sensed by the modified ballast in FIG. 3 will include parasitic capacitive current if there is remote wiring between the ballast and the lamp. However, since such capacitive current will be 90° out of phase with the lamp voltage the average value of the product thereof will be zero and so it will not contribute to the CRECT voltage produced by the α2 IC. Thus, the detection of lamp power in the modified ballast including the α2 IC is no longer subject to error because of the parasitic capacitance of remote wiring.

Figure 4:
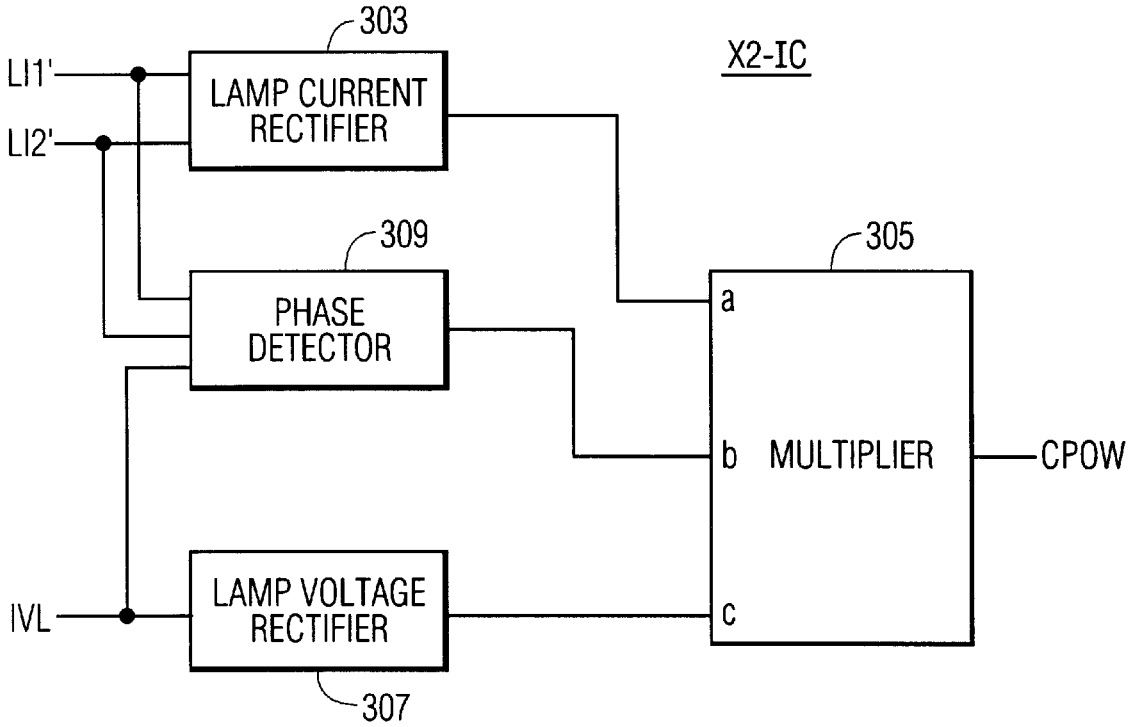
FIG. 4 is a block diagram of the structure of the α2 IC used in FIG. 3.

FIG. 4 shows the basic circuit structure of the α2 IC 301, the pins of which correspond to the pins thereof shown in FIG. 3. It could, in addition, include voltage supply and voltage bias circuitry not relevant to control of lamp intensity. The lamp current rectifier 303 receives from pins LI1' and LI2' a differential voltage corresponding to the lamp current, and converts that voltage into a rectified ac current which is supplied to one input 305*a* of a current-mode single quadrant multiplier 305. Such multipliers are well known in the art. The lamp voltage rectifier 307 receives from pin IVL a current representative of the lamp voltage and converts that into a rectified current which is supplied to a second input 305*b* of multiplier 305. The phase detector 309 is a logic circuit which outputs a high logic value if the lamp voltage and lamp current are both of the same sign, either positive or negative. If the lamp voltage and current are of opposite signs then the sign of the product thereof will be negative and phase detector 309 outputs a low logic value. The output thereof is supplied to a control input 305*c* of multiplier 305 and controls it to produce pin CPOW an output current which is outwardly directed and consequently adds to the then existing voltage level at that pin when the signal at control input 305*c* is high. When the signal at control input 305*c* is low, the output current produced at pin 305 of multiplier 305 will be inwardly directed (sinked) and so will subtract from the then existing voltage level thereat. Thus, an arithmetic summation is effected in accordance with the phase relationship between actual lamp current and voltage, the resultant voltage at pin CPOW thereby being representative of the actual power being supplied to the lamp.

The operation of the improved ballast can be analyzed as follows. The actual power ($P_{real}$) consumed by a load such as lamp 85 can be expressed as $$P_{real} = \frac{1}{T}\int_0^T i(t)\cdot v(t)\cdot dt \tag{1}$$

where v(t) is the voltage across the load and i(t) is the load current. If both are sinusoidal, then $$P_{real} = \frac{I_{peak}\cdot V_{peak}}{2}\cdot \cos\varphi$$

where $I_{peak}$ and $V_{peak}$ are peak values thereof and ϕ is the phase difference there-between.

In the αIC ballast power is calculated as $$P = V_{peak}\cdot\frac{1}{T}\int_0^T |i(t)|\cdot dt$$

Since i(t) is measured without regard to its sign. If i(t) is sinusoidal, then $$P = V_{peak}\cdot\left(\frac{2}{\pi}\right)\cdot I_{peak} \tag{2}$$

Equations (1) and (2) show that power as detected by the ac IC is representative of the actual or "real" power if there is a zero phase difference between load voltage and current. However, that assumption implies that there is no parasitic capacitance across the load. At low dimming levels of the lamp the lamp current will be small, and if the remote wiring is lengthy the resulting parasitic capacitance will be significant and will result in a phase difference approaching 90°. For instance, if ϕ=85° then cos ϕ=0.087. As a result, the value of P as detected by the αIC will be 11.5 times higher than the actual power $P_{real}$.

In contrast thereto, in the α2 IC ballast power is calculated as follows:

$$P = \frac{1}{T}\int_0^T sign\{i(t)\cdot v(t)\}\cdot|i(t)|\cdot|v(t)|\cdot dt \quad (3)$$

where sign $\{i(t)\cdot v(t)\}=1$ if the product $i(t)\cdot v(t) > 0$, and said sign $=-1$if said product is $<0$. Of particular significance is that the value of P as given by equation (3) is the actual power $P_{real}$, for any type of waveform and any value of phase difference. Thus, nonlinearities in lamp voltage and/or current will not affect the accuracy of control of lamp intensity.

In the α2 IC the value of i(t) is provided by the lamp current rectifier 303 and the value of v(t) is provided by the lamp voltage rectifier 307. The sign function is implemented by switching the direction of the current produced at the CPOW pin. The phase detector 309 detects whether the sign function is positive or negative. If positive, the CPOW pin current is directed outward ("sourced") from the pin, and if negative the CPOW pin current is directed inward ("sunk") into the pin. The averaging summation over each cycle of supplied power is implemented by the RC network of resistor 195 and capacitor 192 connected to the CPOW pin.

While the invention has been described with reference to certain preferred embodiments and typical applications thereof, it will be apparent to those skilled in the art that various modifications and adaptations thereof may be made without departing from the essential teachings and scope of the invention as set forth in the ensuing claims.

What is claimed is:

1. An electronic ballast for an electron discharge lamp, said ballast comprising an inverter having a resonant output circuit coupled to the lamp to supply high frequency power thereto, and also comprising a drive control circuit for supplying a switching signal to said inverter having a frequency which is variable in order to control the power supplied to the lamp by said inverter and thereby control the lamp intensity; characterized in that said ballast further comprises:

voltage sensing means coupled to the lamp for producing a signal representative of lamp voltage;

current sensing means coupled to the lamp for producing a signal representative of lamp current; and power calculating means coupled to said voltage sensing means and to said current sensing means for combining the lamp voltage signal and the lamp current signal so as to derive therefrom a signal representative of power supplied to the lamp, the power signal being applied to said drive control circuit to adjust the frequency of said switching signal in accordance with said power signal;

the lamp voltage signal and lamp current signal being combined in such a way that the power signal derived therefrom takes account of any phase difference between lamp voltage and lamp current.

2. An electronic ballast as claimed in claim 1, wherein the lamp voltage signal and lamp current signal are combined by said power calculating means by rectifying each of those signals and multiplying the resulting rectified signals together to derive the products thereof during each quadrant of each operating cycle of said inverter, taking into account the arithmetic signs of said products during each quadrant.

3. An electronic ballast as claimed in claim 1, wherein said power calculating means comprises:

first rectifying means coupled to said voltage sensing means for rectifying the lamp voltage signal;

second rectifying means coupled to the current sensing means for rectifying the lamp current signal; and multiplying means coupled to said first and second rectifying means for deriving a power signal corresponding to the product of the rectified lamp voltage signal and the rectified lamp current signal, taking into account the arithmetic sign of the product of the lamp voltage signal and the lamp current signal during each quadrant of each operating cycle of said inverter.

4. An electronic ballast as claimed in claim 3, wherein said power calculating means further comprises phase detecting means coupled to said voltage sensing means and to said current sensing means for detecting the arithmetic sign of the product of said lamp voltage and lamp current signals, and supplying a sign control signal indicative of said arithmetic sign to said multiplying means to enable it to take account of the arithmetic sign of said product.

5. An electronic ballast as claimed in claim 1, wherein said drive control circuit is comprised in a first integrated circuit chip and said power calculating means is comprised in a second integrated circuit chip.

* * * * *